US011285737B2

(12) United States Patent
Asada et al.

(10) Patent No.: US 11,285,737 B2
(45) Date of Patent: Mar. 29, 2022

(54) HEATER, LIQUID DISCHARGE APPARATUS, AND PRINTER

(71) Applicants: Kohki Asada, Tokyo (JP); Kazuaki Kamihara, Tokyo (JP); Masato Ogawa, Kanagawa (JP); Hiroshi Sawase, Kanagawa (JP); Yoshihiro Takahashi, Tokyo (JP); Genichiroh Kawamichi, Ibaraki (JP); Kenji Nozawa, Ibaraki (JP); Ryusaku Hida, Kanagawa (JP)

(72) Inventors: Kohki Asada, Tokyo (JP); Kazuaki Kamihara, Tokyo (JP); Masato Ogawa, Kanagawa (JP); Hiroshi Sawase, Kanagawa (JP); Yoshihiro Takahashi, Tokyo (JP); Genichiroh Kawamichi, Ibaraki (JP); Kenji Nozawa, Ibaraki (JP); Ryusaku Hida, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/115,814

(22) Filed: Dec. 9, 2020

(65) Prior Publication Data

US 2021/0197584 A1 Jul. 1, 2021

(30) Foreign Application Priority Data

Dec. 27, 2019 (JP) ..... JP2019-239317
Nov. 3, 2020 (JP) ..... JP2020-184017

(51) Int. Cl.
*B41J 11/00* (2006.01)
*B41M 7/00* (2006.01)

(52) U.S. Cl.
CPC ..... *B41J 11/0021* (2021.01); *B41M 7/0081* (2013.01)

(58) Field of Classification Search
CPC .. B41J 11/0021; B41J 29/377; B41M 7/0081; B41M 7/009
See application file for complete search history.

(56) References Cited

U.S. PATENT DOCUMENTS

2012/0140010 A1 6/2012 Ogawa et al.
2012/0140011 A1 6/2012 Yamada et al.
2017/0266987 A1 9/2017 Asada et al.
2017/0266988 A1* 9/2017 Asada ..... F26B 3/283
(Continued)

FOREIGN PATENT DOCUMENTS

JP 2010-143060 7/2010

*Primary Examiner* — Bradley W Thies
(74) *Attorney, Agent, or Firm* — Xsensus LLP

(57) ABSTRACT

A heating device includes a conveyor configured to convey a sheet onto which a liquid is applied in a conveyance direction, an irradiator including a light emitter on an irradiation surface of the irradiator, the light emitter configured to emit light onto the sheet to heat the sheet with the light, a channel plate between the conveyor and the irradiation surface of the irradiator, an airflow generator configured to generate an airflow along the irradiation surface between the irradiation surface of the irradiator and the channel plate, and a suction device configured to suck and discharge the airflow in a direction from the irradiation surface of the irradiator toward the conveyor.

16 Claims, 10 Drawing Sheets

(56) References Cited

U.S. PATENT DOCUMENTS

| | | | |
|---|---|---|---|
| 2017/0266989 | A1 | 9/2017 | Ogawa et al. |
| 2018/0147878 | A1 | 5/2018 | Asada et al. |
| 2018/0264852 | A1 | 9/2018 | Ohtake et al. |
| 2019/0202215 | A1 | 7/2019 | Asada et al. |
| 2019/0204767 | A1 | 7/2019 | Ishihara et al. |
| 2020/0290371 | A1 | 9/2020 | Ogawa |

* cited by examiner

HEATER, LIQUID DISCHARGE APPARATUS, AND PRINTER

CROSS-REFERENCE TO RELATED APPLICATIONS

This patent application is based on and claims priority pursuant to 35 U.S.C. § 119(a) to Japanese Patent Application No. 2019-239317, filed on Dec. 27, 2019, in the Japan Patent Office and Japanese Patent Application No. 2020-184017, filed on Nov. 3, 2020, in the Japan Patent Office, the entire disclosures of which are hereby incorporated by reference herein.

BACKGROUND

Technical Field

Aspects of the present disclosure relate to a heater, a liquid discharge apparatus, and a printer.

Related Art

A printer applies a liquid onto a printing object such as a sheet to perform a printing operation. The printer includes a heater to heat the sheet onto which a liquid is applied to promote drying of the liquid applied onto the sheet.

The printer includes a head, a plurality of light sources, a suction duct, and a communication hole. The head discharges ultraviolet curable ink to a medium. The plurality of light sources irradiates and cures the media to which the ink is applied with light. The suction duct sucks air in a direction opposite to an irradiation direction of the ultraviolet light. The communication hole supplies air between the plurality of light sources. The suction duct of the printer sucks and discharges the air flown along an irradiation surface of the plurality of light sources in a direction opposite to the irradiation direction of the ultraviolet rays.

SUMMARY

In an aspect of this disclosure, a heating device includes a conveyor configured to convey a sheet onto which a liquid is applied in a conveyance direction, an irradiator including a light emitter on an irradiation surface of the irradiator, the light emitter configured to emit light onto the sheet to heat the sheet with the light, a channel plate between the conveyor and the irradiation surface of the irradiator, an airflow generator configured to generate an airflow along the irradiation surface between the irradiation surface of the irradiator and the channel plate, and a suction device configured to suck and discharge the airflow in a direction from the irradiation surface of the irradiator toward the conveyor.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
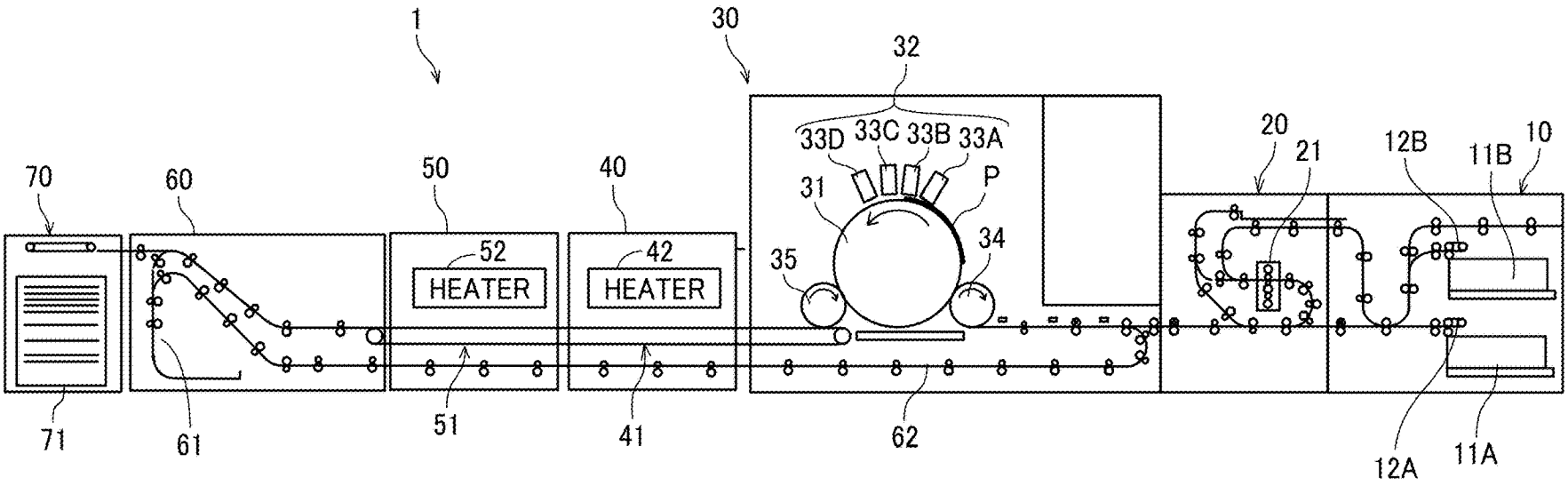
FIG. 1 is a schematic cross-sectional side view of a printer as a liquid discharge apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a," "an," and "the" are intended to include the plural forms as well, unless the context clearly indicates otherwise.

Figure 2:
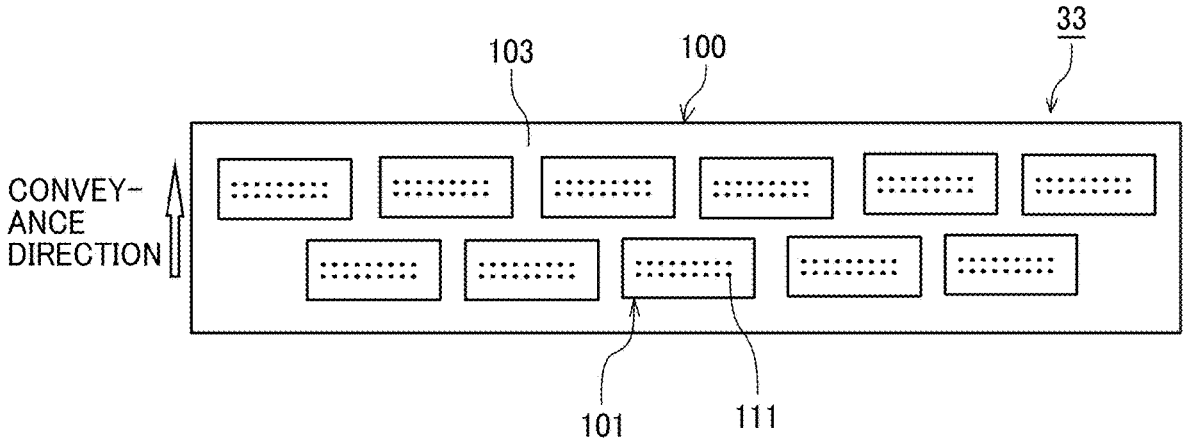
FIG. 2 is a plan view of a discharge unit of the printer.

Referring now to the drawings, wherein like reference numerals designate identical or corresponding parts throughout the several views, embodiments of the present disclosure are described below. A printer as a liquid discharge apparatus according to a first embodiment of the present disclosure is described with reference to FIGS. 1 and 2. FIG. 1 is a schematic cross-sectional side view of the printer 1 according to the first embodiment of the present disclosure. FIG. 2 is a schematic plan view of a discharge unit of the printer 1.

The printer 1 according to the first embodiment includes a loading unit 10 to load a sheet P into the printer 1, a pretreatment unit 20, a printing unit 30, a first dryer 40, a second dryer, a reverse mechanism 60, and an ejection unit 70.

In the printer 1, the pretreatment unit 20 applies, as required, a pretreatment liquid as an application liquid onto the sheet P fed (supplied) from the loading unit 10, the printing unit 30 applies a desired liquid onto the sheet P to perform required printing.

In the printer 1, the first dryer 40 and the second dryer 50 dry the liquid adhering to the sheet P. After the sheet P is reversed upside down by the reverse mechanism 60, the printing unit 30 prints back side of the sheet P to perform printing on both sides of the sheet P and ejects the sheet P to the ejection unit 70. The printing unit may print only one surface of the sheet P and ejects the sheet P to the ejection unit 70 without reversing the sheet P by the reverse mechanism 60.

The loading unit 10 includes loading trays 11 (a lower loading tray 11A and an upper loading tray 11B) to accommodate a plurality of sheets P and feeding devices 12 (a feeding device 12A and a feeding device 12B) to separate and feed the sheets P one by one from the loading trays 11. The loading unit 10 supplies the sheets P to the pretreatment unit 20.

The pretreatment unit 20 includes, e.g., a coater 21 as a treatment-liquid application unit that coats a printing surface of the sheet P with a treatment liquid having an effect of aggregation of ink particles to prevent bleed-through.

The printing unit 30 includes a drum 31 and a liquid discharge device 32. The drum 31 is a bearer (rotating member) that bears the sheet P on a circumferential surface of the drum 31 and rotates. The liquid discharge device 32 discharges a liquid toward the sheet P borne on the drum 31 to apply the liquid onto a surface of the sheet P.

The printing unit 30 includes transfer cylinders 34 and 35. The transfer cylinder 34 receives the sheet P fed from the pretreatment unit 20 and forwards the sheet P to the drum 31. The transfer cylinder 35 receives the sheet P conveyed by the drum 31 and forwards the sheet P to the first dryer 40.

The transfer cylinder 34 includes a sheet gripper to grip a leading end of the sheet P conveyed from the pretreatment unit 20 to the printing unit 30. The sheet P thus gripped by the transfer cylinder 34 is conveyed as the transfer cylinder 34 rotates. The transfer cylinder 34 forwards the sheet P to the drum 31 at a position opposite (facing) the drum 31.

Similarly, the drum 31 includes a sheet gripper on a surface of the drum 31, and the leading end of the sheet P is gripped by the sheet gripper of the drum 31. The drum 31 includes a plurality of suction holes dispersed on a surface of the drum 31, and a suction unit generates suction airflows directed from desired suction holes of the drum 31 to an interior of the drum 31.

The sheet gripper of the drum 31 grips the leading end of the sheet P forwarded from the transfer cylinder 34 to the drum 31, and the sheet P is attracted to and borne on the drum 31 by the suction airflows by the suction device. As the drum 31 rotates, the sheet P is conveyed.

The liquid discharge device 32 includes discharge units 33 (discharge units 33A to 33D) to discharge liquids onto the sheet P as a liquid application unit. For example, the discharge unit 33A discharges a liquid of cyan (C), the discharge unit 33B discharges a liquid of magenta (M), the discharge unit 33C discharges a liquid of yellow (Y), and the discharge unit 33D discharges a liquid of black (K). Further, a discharge unit may discharge a special liquid, that is, a liquid of spot color such as white, gold, or silver.

As illustrated in FIG. 2, for example, each of the discharge unit 33 includes a head module 100 including a full line head and includes a plurality of liquid discharge heads 101 arranged in a staggered manner on a base 103. Each of the liquid discharge head 101 includes a plurality of nozzle rows, and a plurality of nozzles 111 is arranged in each of the nozzle rows. Hereinafter, the liquid discharge head 101 is simply referred to as the "head 101."

The printer 1 controls a discharge operation of each discharge unit 33 of the liquid discharge device 32 by a drive signal corresponding to print data. When the sheet P borne on the drum 31 passes through a region facing the liquid discharge device 32, the liquids of respective colors are discharged from the discharge units 33 toward the sheet P, and an image corresponding to the print data is formed on the sheet P.

The first dryer 40 includes a heater 42 such as an infrared (IR) heater. The heater 42 irradiates the sheet P, to which the liquid is applied, with infrared rays (infrared lights) to heat and dry the sheet P conveyed by a conveyor 41. The second dryer 50 includes a heater 52 such as an ultraviolet (UV) irradiator 521. The heater 52 of the second dryer 50 irradiates the sheet P, to which the liquid is applied and is passed through the first dryer 40, with the ultraviolet rays to heat and dry the sheet P. The conveyor 41 and the conveyor 51 may include a part of the same conveyance mechanism. The infrared (IR) heater and the ultraviolet irradiator 521 are also referred to as "irradiator."

The reverse mechanism 60 includes a reverse path 61 and a duplex path 62. The reverse mechanism 60 reverses the sheet P that has passed through the first dryer 40 and the second dryer 50 to dry a first surface of the sheet P onto which the liquid is applied when the printer 1 performs a duplex printing. The duplex path 62 feeds the reversed sheet P back to upstream of the transfer cylinder 34 of the printing unit 30. The reverse path 61 reverses the sheet P by switchback manner.

The ejection unit 70 includes an ejection tray 71 on which a plurality of sheets P is stacked. The plurality of sheets P conveyed from the reverse mechanism 60 is sequentially stacked and held on the ejection tray 71.

The printer 1 in the first embodiment uses a cut sheet as the sheet P However, the printer 1 according to the first embodiment may be used as an apparatus that prints on a continuous body (web) such as a continuous sheet or a rolled sheet as the sheet P. The printer according to the first embodiment may also be used as an apparatus that prints on a sheet material such as a wallpaper.

Figure 3:
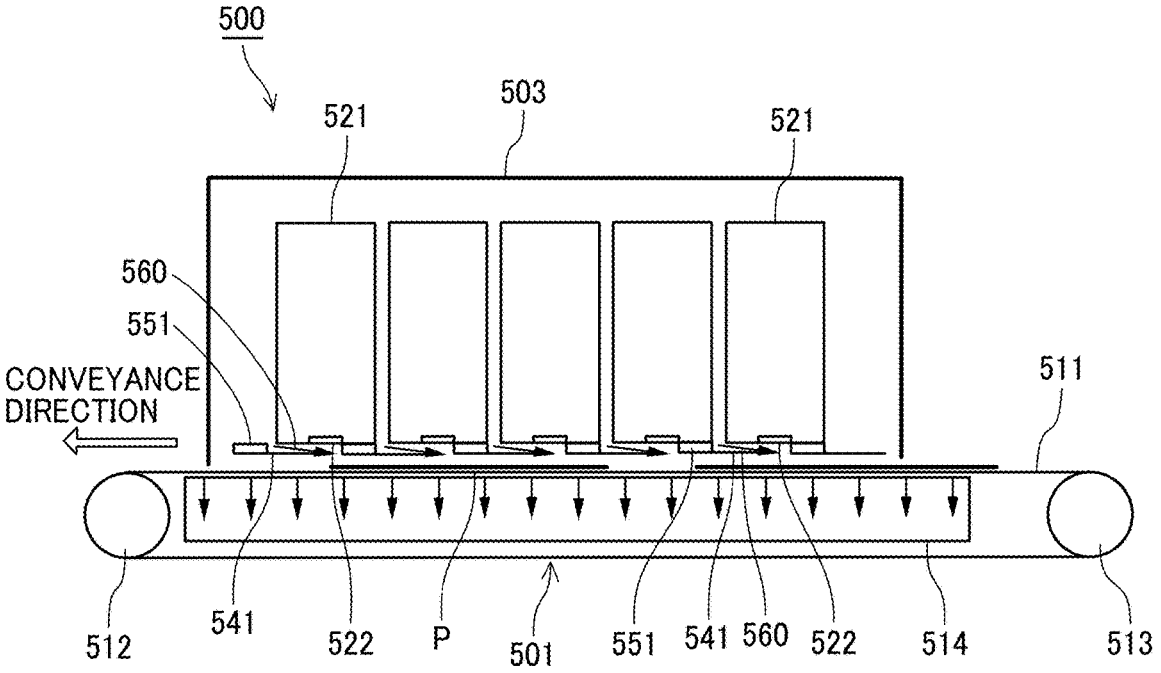
FIG. 3 is a schematic cross-sectional side view of a heating device according to the first embodiment of the present disclosure.
Figure 4:
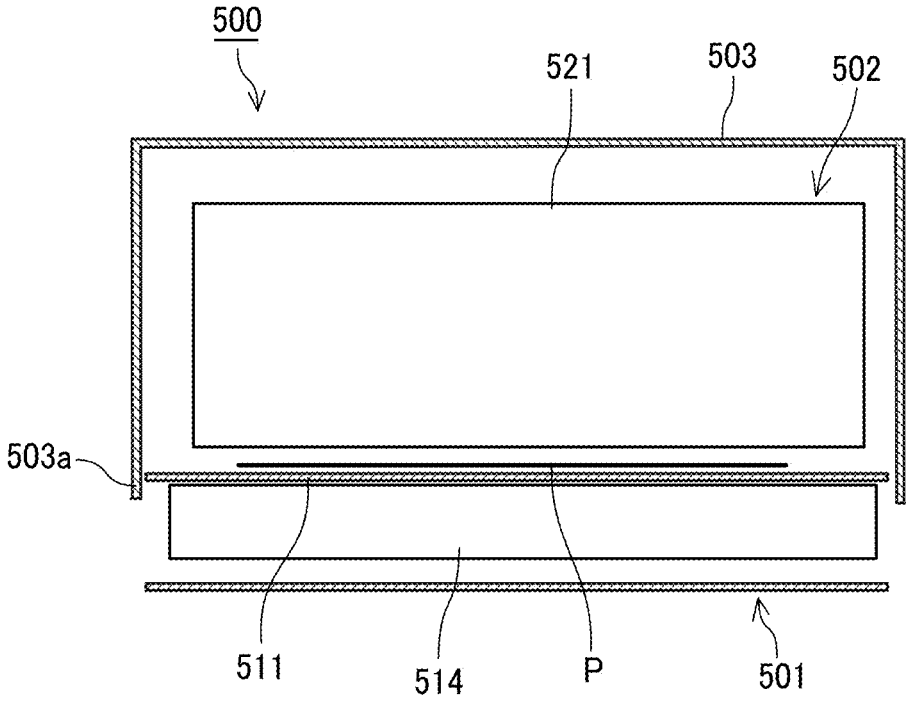
FIG. 4 is a schematic cross-sectional front view of the printer of FIG. 1.

A heating device 500 according to a first embodiment of the present disclosure is described with reference to FIGS. 3 and 4. FIG. 3 is a schematic cross-sectional side view of the heating device 500 according to the first embodiment of the present disclosure. FIG. 4 is a schematic cross-sectional front view of the heating device 500 according to the first embodiment of the present disclosure.

The heating device 500 of the second dryer 50 includes a conveyance mechanism 501 as a conveyor and an ultraviolet irradiator 502 (see FIG. 4) as the heater 52. Thus, the second dryer 50 includes the heating device 500.

The conveyance mechanism 501 includes a conveyance belt 511 that bears and conveys the sheet P. The conveyance belt 511 is an endless belt stretched between a drive roller 512 and a driven roller 513. The conveyance belt 511 rotates to move the sheet P. The conveyance mechanism 501 according to the first embodiment includes a mechanism to convey the sheet P from the printing unit 30 to the reverse mechanism 60 as illustrated in FIG. 1.

The conveyance belt 511 is a belt that includes a plurality of openings from which an air is sucked by a suction chamber 514 arranged inside the conveyance belt 511. The conveyance belt 511 may be, for example, a mesh belt, a flat belt having a suction hole, or the like. The suction chamber 514 includes a suction blower, a fan, or the like to sucks the air through the plurality of openings in the conveyance belt 511 to attract the sheet P to the conveyance belt 511. The conveyor (conveyance mechanism 501) is not limited to the conveyor that uses suction method to attract the sheet P as described above. The conveyor may attract and convey the sheet P on the conveyance belt 511 by, for example, an electrostatic adsorption method or a gripping method using a gripper.

The ultraviolet irradiator 502 includes a plurality of ultraviolet irradiators 521 arranged in a housing 503 along the conveyance direction of the sheet P. The ultraviolet irradiators 521 irradiates the sheet P conveyed by the conveyance mechanism 501 with ultraviolet rays to heat the sheet P. The ultraviolet irradiators 521 serves as a "irradiator." Thus, the ultraviolet irradiator 521 (irradiator) emits ultraviolet light from the irradiation surface 522 to heat the sheet P with ultraviolet light. The irradiator may be the IR heater that emits infrared light from the irradiation surface 522 to heat the sheet P with infrared light.

A channel plate 541 is arranged between the conveyance belt 511 of the conveyance mechanism 501 as the conveyor and an irradiation surface 522 of the ultraviolet irradiators 521 as the heater.

The channel plate 541 may be, for example, a general metal plate, a reflector to return the light reflected from the sheet P to the sheet P again, or the like. The channel plate 541 is disposed at a position close to the irradiation surface 522 to a degree in which the channel plate 541 does not block the ultraviolet light (UV light) emitted from the irradiation surface 522 of the ultraviolet irradiator 521.

Further, the heating device 500 includes an airflow generator 551 to generate an airflow 560 flow along the irradiation surface 522. the airflow generator 551 is disposed between the irradiation surface 522 of the ultraviolet irradiator 521 as the heater and the channel plate 541.

Here, the suction chamber 514 also serves as a suction device to suck and discharge the airflow 560 along the irradiation surface 522 in a direction from the irradiation surface 522 toward the openings in the conveyance belt 511 of the conveyance mechanism 501.

As illustrated in FIG. 3, the housing 503 is arranged to have a gap with the conveyance belt 511 in a vertical direction and a direction along the conveyance direction of the sheet P. The housing 503 includes an extension portion 503*a* extended lower than conveyance belt 511 in a vertical (height) direction perpendicular to the conveyance direction of the sheet P.

Figure 5:
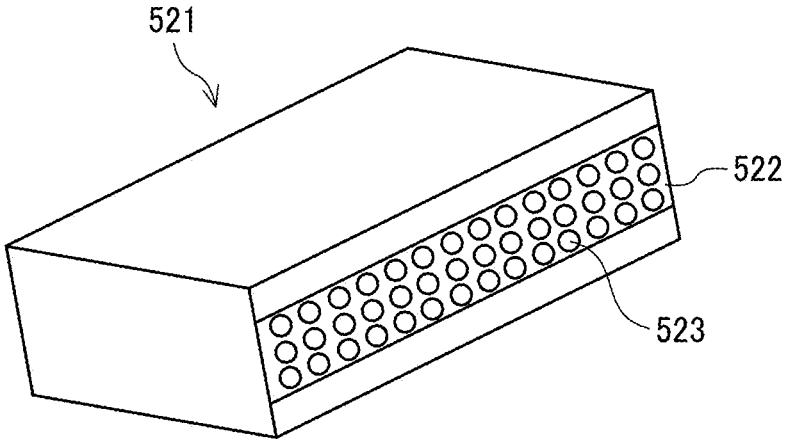
FIG. 5 is a schematic perspective view of an example of the ultraviolet irradiator.

Next, an example of the ultraviolet irradiator 521 is described with reference to FIG. 5. FIG. 5 is a schematic perspective view of an example of the ultraviolet irradiator 521.

The ultraviolet irradiator 521 includes granular ultraviolet emitting diode elements 523 (UV-LED elements) arranged in a grid pattern on the irradiation surface 522. Since the UV-LED elements 523 emit light at the same illuminance, the ultraviolet irradiator 521 uniformly emits light along the irradiation surface 522 as a whole. As a wavelength of the ultraviolet light (UV light), a wavelength having a peak wavelength of 395 nm and a wavelength distribution having a full width at half maximum of about 15 nm is used.

The ultraviolet irradiator 521 can selectively heat the sheet P by irradiating the sheet P with ultraviolet rays. Thus, the ultraviolet irradiator 521 can obtain an effect of heating only an image part (a part to which the liquid is applied) and not excessively raising a temperature of a blank part (a part to which the liquid is not applied).

A result of comparison between the UV-LED elements 523 and the infrared (IR) heater (IR lamp) is illustrated below. The UV-LED elements 523 and the infrared (IR) heater (IR lamp) are also referred to as a "light emitter" that emits ultraviolet light or infrared light.

The surface temperature of the sheet P after the sheet P has passed through the dryer is measured while heating conditions (output settings of the IR lamp and the UV-LED elements 523) are varied to measure the temperatures of the image part and the blank part. When the temperature of the image part rises to around 90° C., moisture and solvent in a water-based ink evaporate and dry.

When the IR lamp heats the sheet P with a setting in which the temperature of the image part in the sheet P becomes 90° C., the temperature of the blank part in the sheet P became 105° C. at the same time of heating the image part. Conversely, when the UV-LED elements 523 heats the sheet P with a setting in which the temperature of the image part becomes 90° C., the temperature of the blank part in the sheet P became 45° C. that was about 60° C. lower than the temperature of the blank part heated by the IR lamp.

Due to such a difference in the temperature of the blank part, moisture content of the blank part decreased from 6.1% to 1.4% by the heating of the IR lamp, whereas the moisture content of the blank part decreased only from 6.1% to 2.9% in the heating of the UV-LED elements 523. That is, it was confirmed that the sheet P can retain more moisture in the blank part after the sheet P is heated (dried) by the ultraviolet ray emitted from the UV-LED elements 523.

Figure 6:
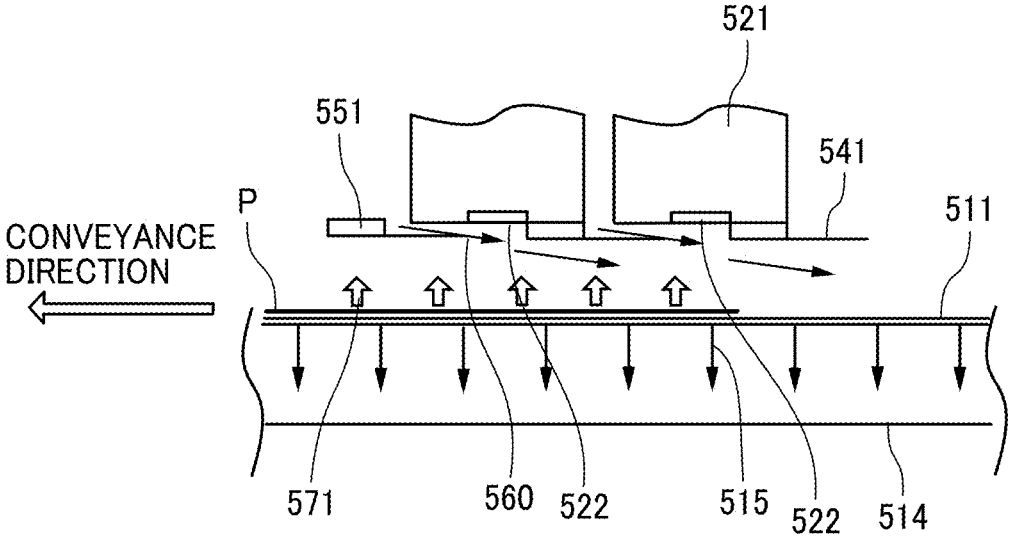
FIG. 6 is a schematic cross-sectional side view of the heating device in a state in which one sheet is conveyed to describe the effect of the heating device.
Figure 7:
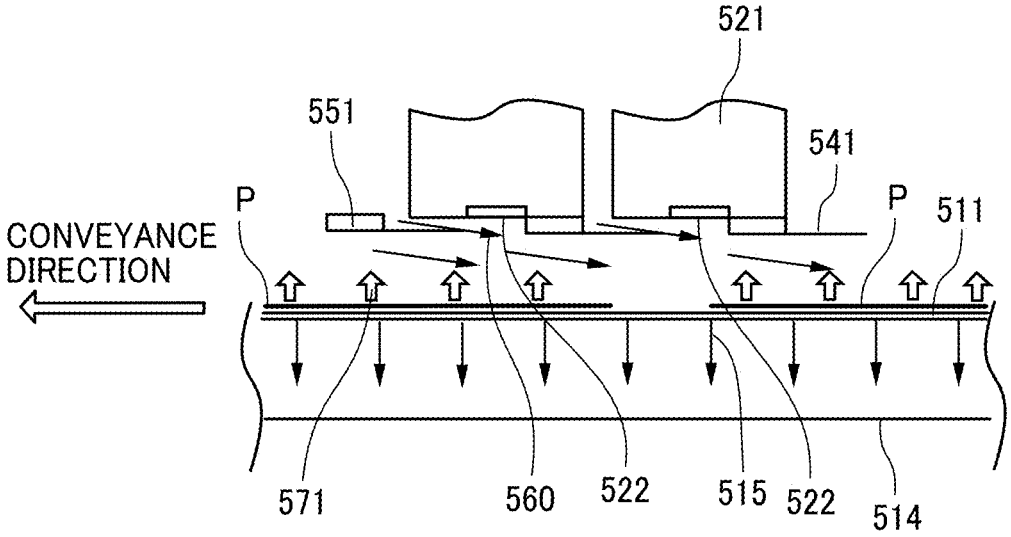
FIG. 7 is a schematic cross-sectional side view of the heating device in a state in which two sheets are conveyed to describe the effect of the heating device.

Next, an effect of the heating device 500 according to the first embodiment is illustrated with reference to FIGS. 6 and 7. FIG. 6 is a schematic cross-sectional side view of the heating device 500 in a state in which one sheet P is conveyed to illustrate the effect of the heating device 500. FIG. 7 is a schematic cross-sectional side view of the heating device 500 in a state in which two sheets P are conveyed to illustrate the effect of the heating device 500.

The airflow 560 generated by the airflow generator 551 flows upstream (right side in FIG. 7) in the conveyance direction as indicated by arrow in FIG. 7 along the irradiation surface 522 of the channel plate 541 and the ultraviolet irradiator 521. In other words, the airflow 560 flows in a direction opposite to the conveyance direction of the sheet P (from left to right in FIG. 7). Thus, the airflow 560 does not directly hit the sheet P on the conveyance belt 511. Thus, the airflow does not cool the sheet P, and the heating device 500 can improve the drying efficiency of the sheet P.

Then, a vapor 571 generated from the liquid in the sheet P heated by the ultraviolet irradiation emitted from the ultraviolet irradiator 521 rises toward the irradiation surface 522 of the ultraviolet irradiator 521. However, the airflow 560 blows the vapor 571 to upstream in the conveyance direction (from left to right in FIG. 7) so that the vapor 571 does not reach the irradiation surface 522.

Then, the airflow 560 containing the vapor 571 is sucked by a suction airflow 515 generated by the suction chamber 514 in a region of the conveyance belt 511 upstream of the sheet P in the conveyance direction, on which the sheet P is not placed, in an example in which one sheet P is conveyed as illustrated in FIG. 6. Thus, the heating device 500 can discharge air containing vapor before the next sheet P is conveyed and reach to the heating device 500.

Further, the airflow 560 containing the vapor 571 is sucked by the suction airflow 515 generated by the suction chamber 514 in a region between two sheets P on the conveyance belt 511 in the conveyance direction, on which the sheet P is not placed, in an example in which two sheets P are conveyed as illustrated in FIG. 7.

As described above, the heating device 500 blows the airflow 560 along the irradiation surface 522 of the ultraviolet irradiator 521 and sucks and discharges the airflow 560 containing the vapor 571 rising upward by the suction chamber 514 at the conveyance belt 511 opposite to the irradiation surface 522.

Thus, the airflow 560 generated by the airflow generator 551 is discharged without directly hitting the sheet P on the conveyance belt 511. Thus, the heating device 500 can improve the drying efficiency of the ultraviolet irradiator 521.

The heating device 500 removes the vapor on the surface of the sheet P that contributes to improve the drying property of the heating device 500.

When a conveyance method other than a suction conveyance is adopted, the heating device 500 may include a discharge port arranged in a direction perpendicular to the conveyance direction of the sheet P to suck the airflow 560. That is, the heating device 500 discharge the airflow 560, which flows upstream in the conveyance direction along the channel plate 541 above the sheet P, downward at a region between the two sheets P. Thus, the heating device 500 can prevents the airflow 560 to directly hit the sheet P while discharging the airflow 560 in a state in which no airflow flows toward the irradiation surface 522. The heating device 500 thus configured has an effect of not soiling the irradiation surface 522 while keeping the drying property of the heating device 500.

The heating device 500 preferably discharges air (airflow) containing the vapor 571 in a direction opposite to the ultraviolet irradiator 521 from a viewpoint of explosion proof.

Further, although light emitting elements of the ultraviolet irradiator 521 has to be cooled because the emitting elements of the ultraviolet irradiator 521 generates heat. However, the airflow 560 that flows along the irradiation surface 522 can cool the irradiation surface 522. Further, the heating device 500 heats sheet P on the conveyance belt 511 with the ultraviolet irradiator 521 so that the temperature of the conveyance belt 511 increases that prevents generation of condensation on the conveyance belt 511.

Thus, the heating device 500 includes a conveyor (conveyance mechanism 501) configured to convey the sheet P onto which a liquid is applied in the conveyance direction, an irradiator (ultraviolet irradiator 521) including a light emitter (UV-LED elements 523) on an irradiation surface 522 of the irradiator, the light emitter configured to emit light onto the sheet P to heat the sheet P with the light, the channel plate 541 between the conveyor (conveyance mechanism 501) and the irradiation surface 522 of the irradiator (ultraviolet irradiator 521), the channel plate 541 arranged parallel to the irradiation surface 522 of the irradiator (ultraviolet irradiator 521), the airflow generator 551 configured to generate the airflow 560 along the irradiation surface 522 between the irradiation surface 522 of the irradiator (ultraviolet irradiator 521) and the channel plate 541, and the suction device (suction chambers 516) configured to suck and discharge the airflow 560 in a direction from the irradiation surface 522 of the irradiator (ultraviolet irradiator 521) toward the conveyor (conveyance mechanism 501).

Figure 8:
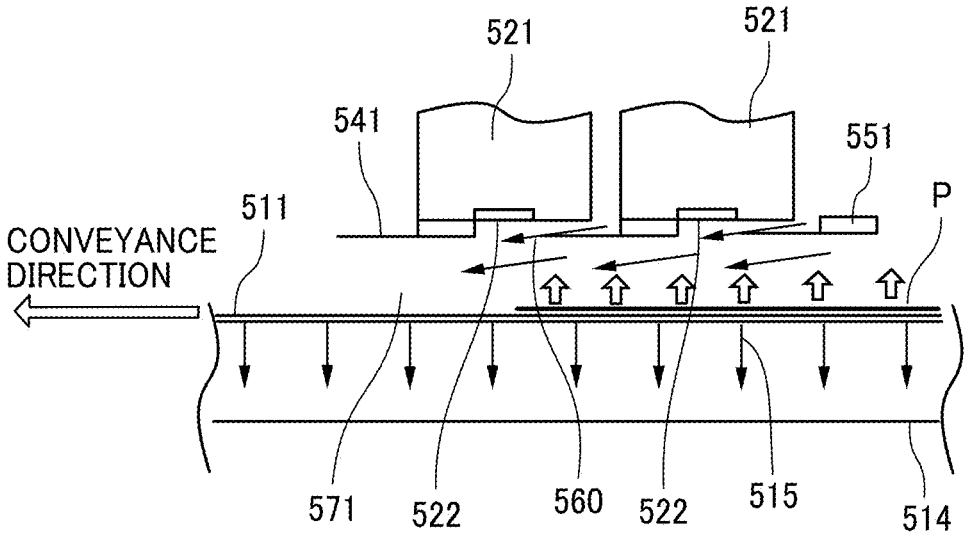
FIG. 8 is a schematic cross-sectional side view of the heating device according to a second embodiment of the present disclosure.

A heating device 500 according to a second embodiment of the present disclosure is described with reference to FIG. 8. FIG. 8 is a schematic cross-sectional side view of the heating device 500 according to the second embodiment of the present disclosure.

The heating device 500 according to the second embodiment has a configuration in which the airflow 560 flows in a direction from upstream to downstream (right to left in FIG. 8) in the conveyance direction of the sheet P.

The airflow 560 flows from upstream to downstream (right to left in FIG. 8) in the conveyance direction so that the airflow 560 does not roll up a tip of the sheet P. Thus, the conveyance belt 511 can stably conveys the sheet P. In the above case, even if a rear end of the sheet P flutters due to the airflow 560, the sheet P only comes into contact with the channel plate 541, and the sheet P does not cause paper jam.

Further, the heating device 500 in the first embodiment has to set an air volume and a wind speed to prevent the vapor 571 from attaching to the irradiation surface 522 to be balanced with an air volume and a wind speed to reduce fluttering of the tip of the sheet P because the airflow 560 flows from downstream to upstream (left to right in FIG. 7) in the heating device 500 according to the first embodiment.

That is, the heating device 500 has to increase the air volume and the wind speed to prevent the vapor 571 from attaching to the irradiation surface 522 whereas the heating device 500 has to decrease the air volume and the wind speed to reduce fluttering of the tip of the sheet P.

Conversely, the heating device 500 according to the second embodiment only has to set the air volume and the wind speed to prevent the vapor 571 from adhering to the irradiation surface 522 without considering the fluttering of the tip of the sheet P. Thus, the heating device 500 according to the second embodiment can increase a degree of freedom in setting the air volume and the wind speed.

Figure 9:
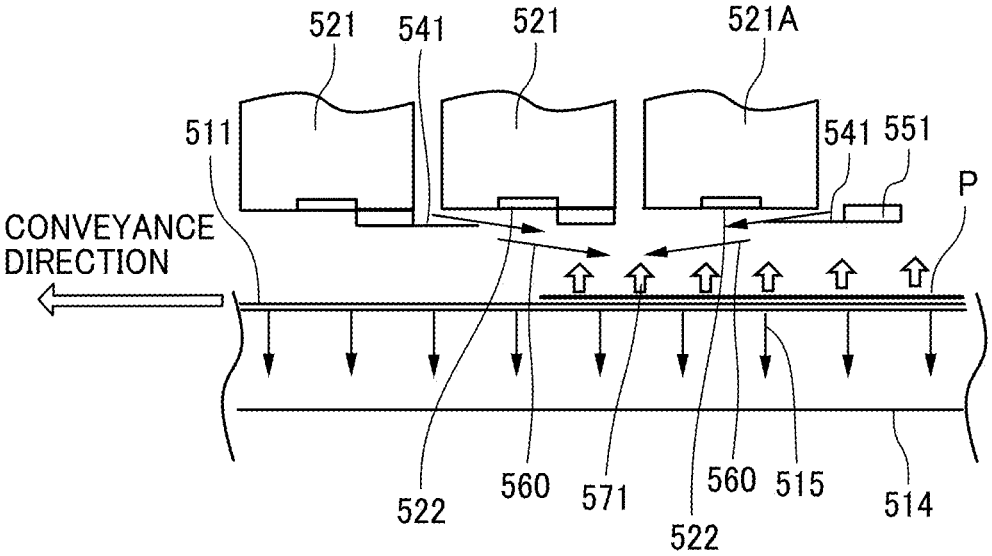
FIG. 9 is a schematic cross-sectional side view of the heating device according to a third embodiment of the present disclosure.

A heating device 500 according to a third embodiment of the present disclosure is described with reference to FIG. 9. FIG. 9 is a schematic cross-sectional side view of the heating device 500 according to the third embodiment of the present disclosure.

The heating device 500 according to the third embodiment includes a most upstream ultraviolet irradiator 521A that includes the airflow generator 551 that generates an airflow 560 flowing from upstream to downstream (from right to left in FIG. 9) in the conveyance direction of the sheet P.

The most upstream ultraviolet irradiator 521A is disposed at the most upstream (most right side in FIG. 9) of a plurality of ultraviolet irradiators 521 arranged along the conveyance direction of the sheet P. The ultraviolet irradiators 521 other than the most upstream ultraviolet irradiators 521A generate the airflows 560 flowing from downstream to upstream (from left to right in FIG. 9) in the conveyance direction of the sheet P as in the heating device 500 according to the first embodiment.

If the airflow generator 551 generates an airflow 560 that flows from downstream to upstream (from left to right in FIG. 9) in the conveyance direction for the most upstream ultraviolet irradiator 521A as in the first embodiment (see FIG. 7), the tip of the sheet P conveyed through a gap between the housing 503 (see FIG. 4) and the conveyance belt 511 may be lifted.

Therefore, the heating device 500 includes the airflow generator 551 for the most upstream ultraviolet irradiator 521A that generates the airflow that flows from upstream to downstream (from right to left in FIG. 9) in the conveyance direction of the sheet P. The most upstream ultraviolet irradiator 521A serves as an inlet for the sheet P to the plurality of ultraviolet irradiators 521. Thus, the heating device 500 according to the third embodiment can smoothly feed the sheet P to face the ultraviolet irradiators 521 while preventing the sheet P from separating from (liftoff) the conveyance belt 511.

Figure 10:
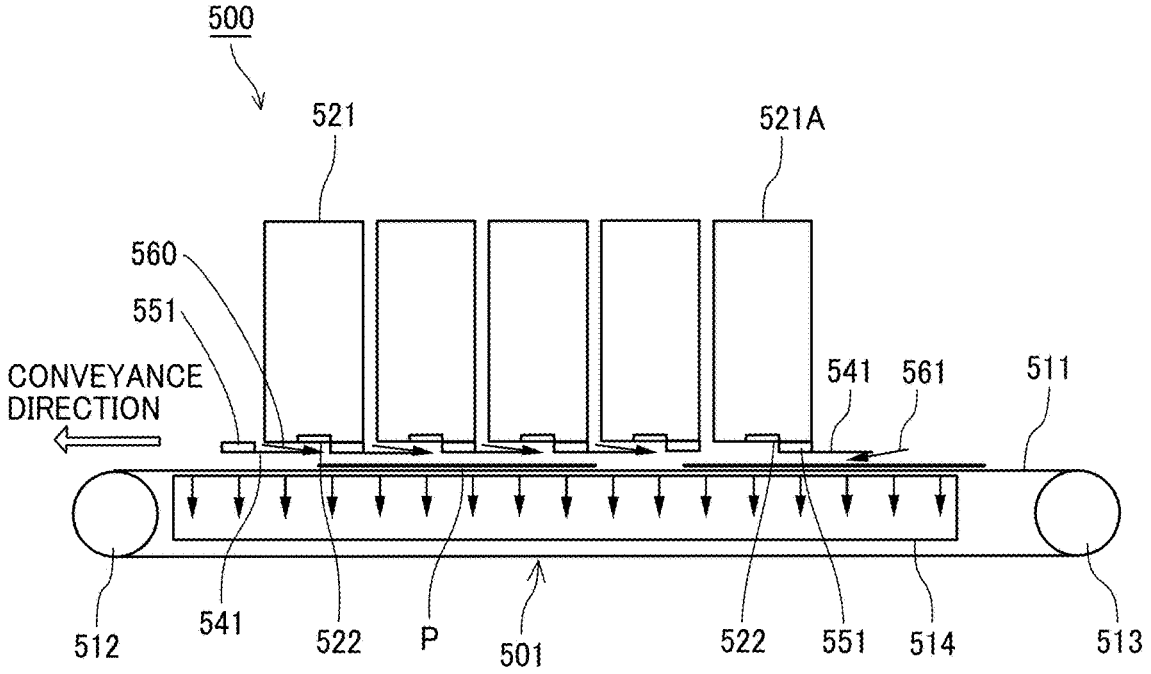
FIG. 10 is a schematic cross-sectional side view of the heating device according to a fourth embodiment of the present disclosure.

A heating device 500 according to a fourth embodiment of the present disclosure is described with reference to FIG. 10. FIG. 10 is a schematic cross-sectional side view of the heating device 500 according to the fourth embodiment of the present disclosure.

The heating device 500 according to the fourth embodiment includes a most upstream ultraviolet irradiator 521A that includes the airflow generator 551 that does not generate an airflow 560. The ultraviolet irradiator 521A is disposed at the most upstream (most right side in FIG. 9) of a plurality of ultraviolet irradiators 521 arranged along the conveyance direction of the sheet P.

When the most upstream ultraviolet irradiator 521A heats the sheet P, an amount of vapor 571 generated at an initial stage of heating is small, and an airflow 561 taken in from upstream of the heating device 500 naturally generates an airflow along the irradiation surface 522.

Therefore, the airflow generator 551 of the most upstream ultraviolet irradiator 521A does not generate the airflow 560 to reduce a power consumption of the ultraviolet irradiator 521A.

In the heating device 500 according to fourth embodiment as described above, the most upstream ultraviolet irradiator 521A includes the airflow generator 551 that does not generate the airflow 560 so that the plurality of ultraviolet irradiators 521 can be unified. Conversely, if the most upstream ultraviolet irradiator 521A does not include the airflow generator 551, a cost of the heating device 500 can be reduced. In another configuration, the airflow generator 551 most upstream in the conveyance direction of the plurality of airflow generators 551 switches operations between a first operation configured to generate the airflow 560 and a second operation configured not to generate the airflow 560.

Thus, the irradiator (ultraviolet irradiator 521) includes a plurality of irradiators (ultraviolet irradiators 521) along the conveyance direction, and the airflow generator 551 includes a plurality of airflow generators 551 for the plurality of irradiators (ultraviolet irradiators 521), respectively. The airflow generator 551 most upstream in the conveyance direction of the plurality of airflow generators 551 does not generate the airflow 560, and the plurality of airflow generators 551 other than the airflow generator 551 most upstream in the conveyance direction generates the airflow 560 along the irradiation surface.

Further, the airflow generator 551 most upstream in the conveyance direction of the plurality of airflow generators 551 may switch operations between a first operation to generate the airflow 560 and a second operation not to generate the airflow 560.

Figure 11:
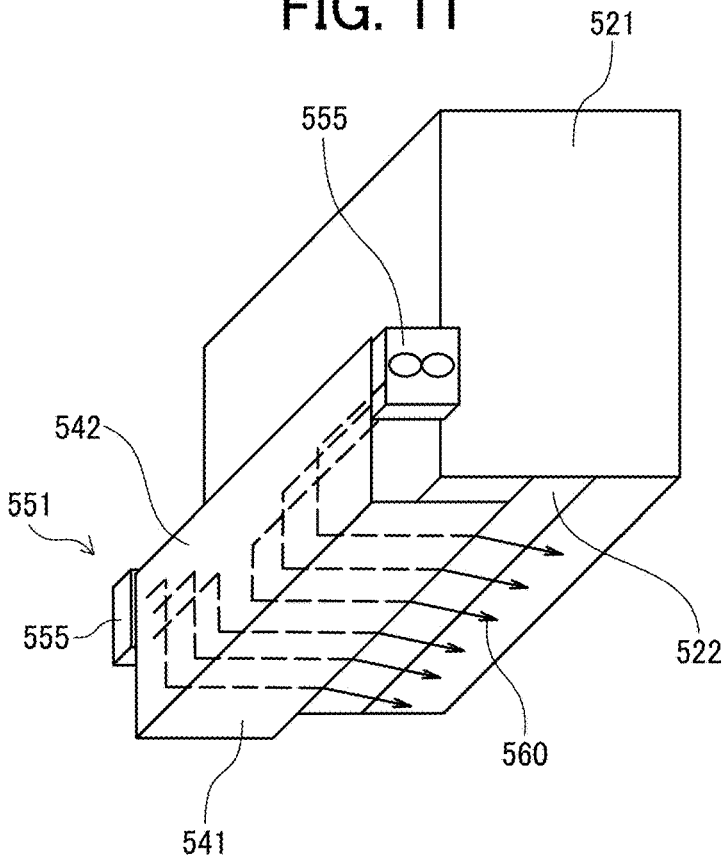
FIG. 11 is a partial perspective view of the ultraviolet irradiator to illustrate the airflow generator of the heating device according to a fifth embodiment of the present disclosure.

A heating device 500 according to a fifth embodiment of the present disclosure is described with reference to FIG. 11. FIG. 11 is a partial perspective view of the ultraviolet irradiator 521 to illustrate the airflow generator 551 of the heating device 500 according to the fifth embodiment of the present disclosure.

The airflow generator 551 includes two intake fans 555 arranged at both ends (front to rea direction in FIG. 11) of the ultraviolet irradiators 521 in a direction perpendicular to the conveyance direction. An air taken in by the intake fan 555 is guided by a guide plate 542 formed together with the channel plate 541 as a single unit to become an airflow 560 flowing along the irradiation surface 522.

Two intake fans 555 suck (intake) air in a direction perpendicular to the conveyance direction. Thus, the heating device 500 can reduce an unevenness of the airflow 560 in the direction perpendicular to the conveyance direction.

Thus, the heating device 500 includes a guide plate 542 vertically arranged in a direction perpendicular to the conveyance direction. The channel plate 541 is horizontally joined to the guide plate 542 at corners of the guide plate 542 and the channel plate 541 such that the channel plate 541 and the guide plate 542 form a right angle. An angle formed by the guide plate 542 and the channel plate 541 may be angles other than right angle such as angle from 60° to 120°.

Figure 12:
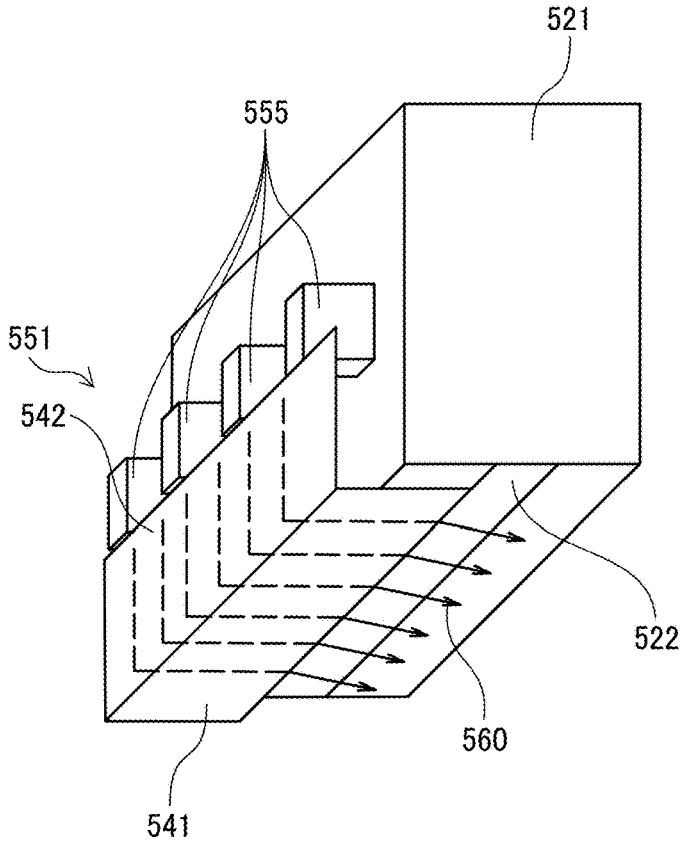
FIG. 12 is a partial perspective view of the ultraviolet irradiator to illustrate the airflow generator of the heating device according to a sixth embodiment of the present disclosure.

The airflow generator 551 includes a plurality of intake fans 555 at both ends of the ultraviolet irradiator 521 in a direction perpendicular to the conveyance direction (from front to rear direction in FIG. 12). The plurality of intake fans 555 generates the airflow 560 in a horizontal direction along the guide plate 542.

Thus, the airflow 560 flows from the intake fans 555 in a horizontal direction along the guide plate 542 and then flows downward to the channel plate 541 to change a flow direction from a vertical direction to a horizontal direction by the channel plate 541 horizontally joined to the guide plate 542. Thus, the airflow 560 flows along the channel plate 541 that is along the irradiation surface 522.

The air taken in by the intake fan 555 is preferably taken in from outside the printer 1 because the air in the heating device 500 or in an interior of the second dryer 50 may contain the vapor 571.

The heating device 500 can control a voltage and a pulse-width modulation to control an amount of air-intake of the intake fan 555. The heating device 500 determines an amount of air-intake according to a type of sheet P and an amount of liquid applied on the sheet P. For example, an amount of ink adhered on the sheet P may be used as the amount of liquid applied on the sheet P. The amount of air-intake can be set automatically or arbitrarily by the user.

Since it is difficult to raise a temperature of the thick sheet P, the heating device 500 reduce the amount of air-intake to increase an effect of a temperature increase of the sheet P, for example. Conversely, since temperature of the thin sheet P easily increases, the heating device 500 increase the amount of air-intake to increase an effect of preventing the condensation on the conveyance belt 511.

The heating device 500 increases the amount of air-intake when the amount of ink adhering to the sheet P is large to prevent the vapor 571 from attaching to the irradiation surface 522. Conversely, the heating device 500 reduce the amount of air-intake when the amount of ink adhered on the sheet P is small.

A heating device 500 according to a sixth embodiment of the present disclosure is described with reference to FIG. 12. FIG. 12 is a partial perspective view of the ultraviolet irradiator 521 to illustrate the airflow generator 551 of the heating device 500 according to the sixth embodiment of the present disclosure.

The heating device 500 according to the sixth embodiment includes a plurality of the intake fans 555 arranged in a direction perpendicular to the conveyance direction of the sheet P (from front to rear direction in FIG. 12). Each of the plurality of intake fans 555 includes a discharge port on a lower end of the intake fan 555 so that the air is discharged downward from the discharge port. The air discharged from the intake fans 555 changes a flow direction from a vertical direction to a horizontal direction by the guide plate 542 and the channel plate 541 and flow along the channel plate 541 as the airflow 560.

The intake fan 555 thus configured can generate a uniform airflow 560 along the irradiation surface 522.

However, the intake fan 555 preferably includes a suction port communicating with outside of the second dryer 50 via a duct or the like to take in the air outside the second dryer 50 as described above.

Further, the air taken in by the intake fan 555 in the fifth embodiment (see FIG. 11) and the sixth embodiment (see FIG. 12) is dehumidified. Dehumidification of the air taken in by the intake fan 555 can reliably prevent condensation on the irradiation surface 522.

Thus, the heating device 500 includes the guide plate 542 vertically arranged in a direction perpendicular to the conveyance direction. The channel plate 541 is horizontally joined to the guide plate 542 at corners of the guide plate 542 and the channel plate 541 such that the channel plate 541 and the guide plate 542 form a right angle. An angle formed by the guide plate 542 and the channel plate 541 may be angles other than right angle such as angle from 60° to 120°.

The airflow generator 551 includes a plurality of intake fans 555 along a longitudinal surface of the ultraviolet irradiator 521 in a direction perpendicular to the conveyance direction (from front to rear direction in FIG. 12). The plurality of intake fans 555 generates the airflow 560 in a vertical direction from the irradiation surface 522 toward the conveyance mechanism 501 (conveyor).

Thus, the airflow 560 flows from the intake fans 555 vertically downward along the guide plate 542 and then changes a flow direction from a vertical direction to a horizontal direction by the channel plate 541 horizontally joined to the guide plate 542. Thus, the airflow 560 flows along the channel plate 541 that is along the irradiation surface 522.

Figure 13:
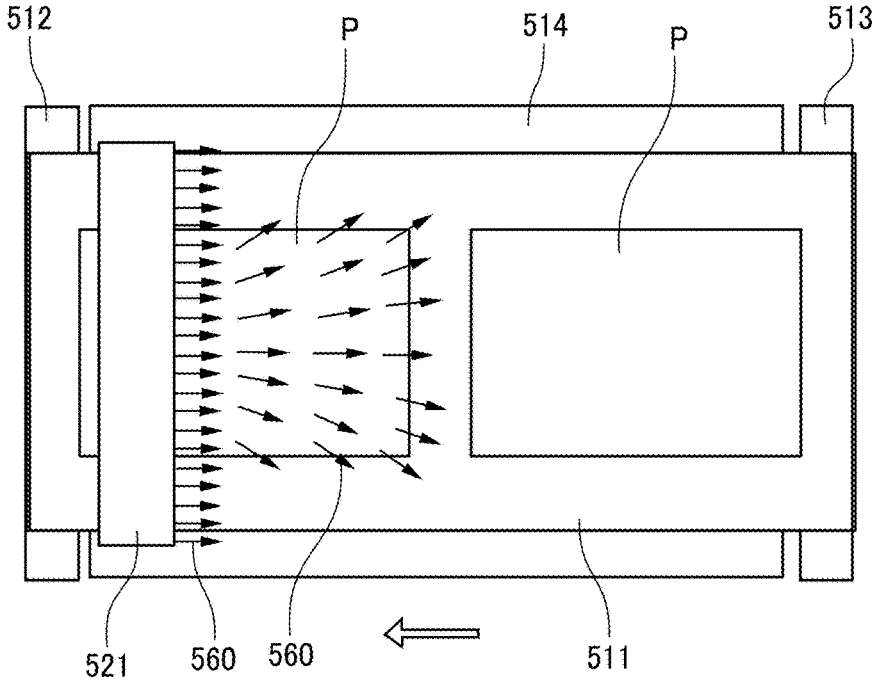
FIG. 13 is a schematic plan view of the heating device according to a sixth embodiment to illustrate the airflow on a surface of the sheet along an irradiation surface.

Next, a flow of an airflow 560 along the irradiation surface 522 on a surface of the sheet P for each above-described embodiment is described with reference to FIG. 13. FIG. 13 is a schematic plan view of the heating device 500 according to the sixth embodiment to illustrate the airflow 560 on a surface of the sheet P along the irradiation surface 522. Further, only one ultraviolet irradiator 521 is illustrated in FIG. 13 for simplicity.

The airflow 560 emitted from the ultraviolet irradiator 521 onto the sheet P is sucked from a portion of the conveyance belt 511 between the two sheets P into the suction chamber 514 as a flow, a flow direction of which is parallel to the conveyance direction at a central part of the flow in the width direction of the sheet P. The width direction of the sheet P is perpendicular to the conveyance direction of the sheet P.

Further, the airflow 560 discharged from both ends of the sheet Pin the width direction is sucked into the suction chamber 514 from the conveyance belt 511 in a region outside of the sheet P in the width direction of the sheet P.

The airflow 560 discharged onto the sheet P to the suction chamber 514 is thus sucked into the suction chamber 514 without staying on the surface of the sheet P. Since the airflow 560 is sucked below the conveyance belt 511 in the region in which the sheet P is not placed, no airflow that interferes with the conveyance of the sheet P is generated.

Figure 14:
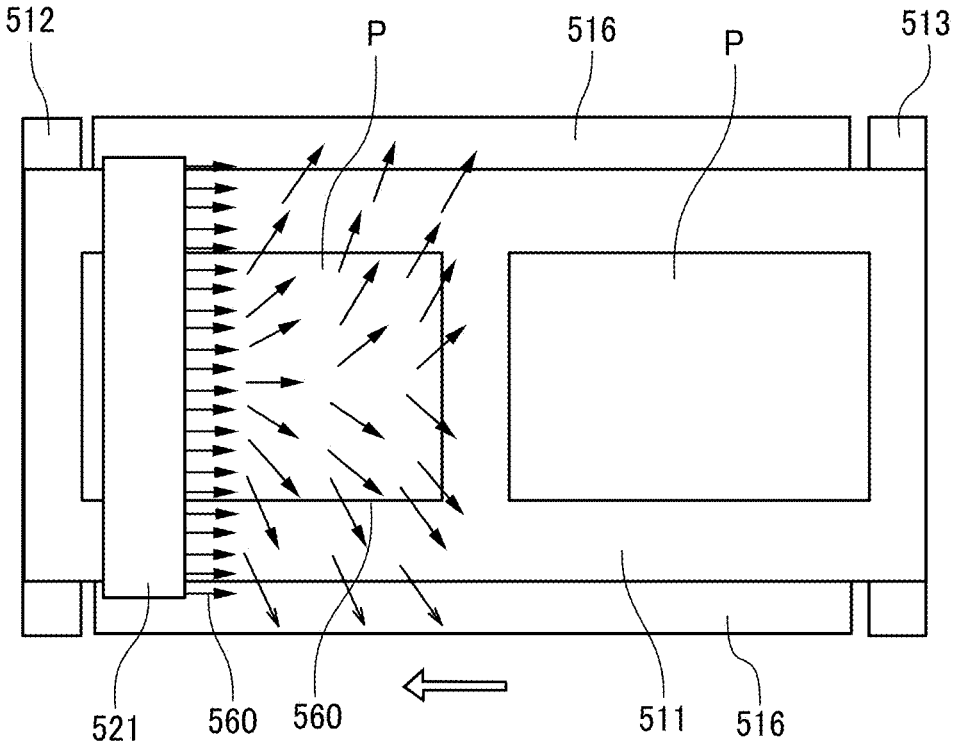
FIG. 14 is a schematic plan view of the heating device according to a seventh embodiment of the present disclosure.

A heating device 500 according to a seventh embodiment of the present disclosure is described with reference to FIG. 14. FIG. 14 is a schematic plan view of the heating device 500 according to the seventh embodiment of the present disclosure. Further, only one ultraviolet irradiator 531 is illustrated in FIG. 14 for simplicity.

The heating device 500 according to the seventh embodiment includes suction chambers 516 serving as a suction device on both ends of the conveyance belt 511 in the width direction of the conveyance belt 511. The width direction of the conveyance belt 511 is perpendicular to the conveyance direction of the sheet P. The conveyance belt 511 uses a belt that is not a suction type. Thus, no suction holes are formed in the conveyance belt 511.

The heating device 500 according to the seventh embodiment sucks the airflow 560 discharged from the ultraviolet irradiator 521 onto the sheet P and the conveyance belt 511 into the suction chambers 516 on the both ends of the conveyance belt 511.

Figure 15:
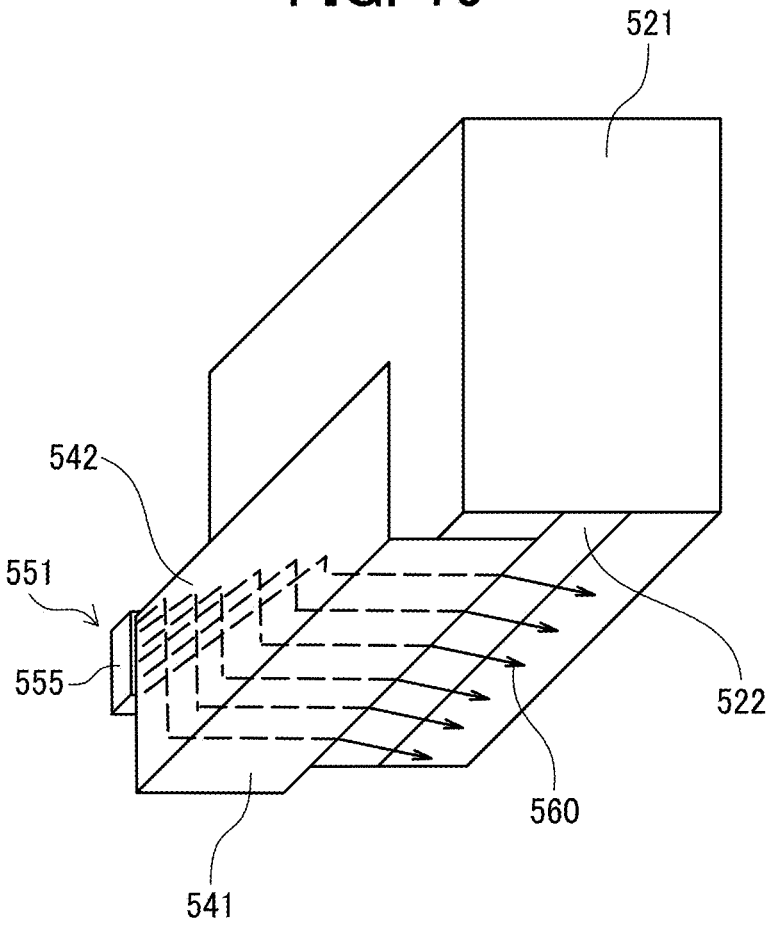
FIG. 15 is a partial perspective view of the ultraviolet irradiator to illustrate the airflow generator of the heating device according to an eighth embodiment of the present disclosure.

The heating device 500 according to an eighth embodiment of the present disclosure is described with reference to FIG. 15. FIG. 15 is a partial perspective view of the ultraviolet irradiator 521 to illustrate the airflow generator 551 of the heating device 500 according to the eighth embodiment of the present disclosure.

The airflow generator 551 includes an intake fan 555 arranged at one end (rear end in FIG. 15) of the ultraviolet irradiator 521 in a direction perpendicular to the conveyance direction of the sheet P, that is a width direction of the ultraviolet irradiator 521 (from front to rear direction in FIG. 15).

An air taken in by the intake fan 555 is guided by a guide plate 542 formed together with the channel plate 541 as a single unit to become an airflow 560 flowing along the irradiation surface 522.

When a space of the guide plate 542 is sufficiently wider than a space of the channel plate 541, the ultraviolet irradiator 521 can reduce an unevenness of the airflow 560 in the width direction of the ultraviolet irradiator 521.

A heating device 500 according to a ninth embodiment of the present disclosure is described with reference to FIGS. 16 and 17.

Figure 16:
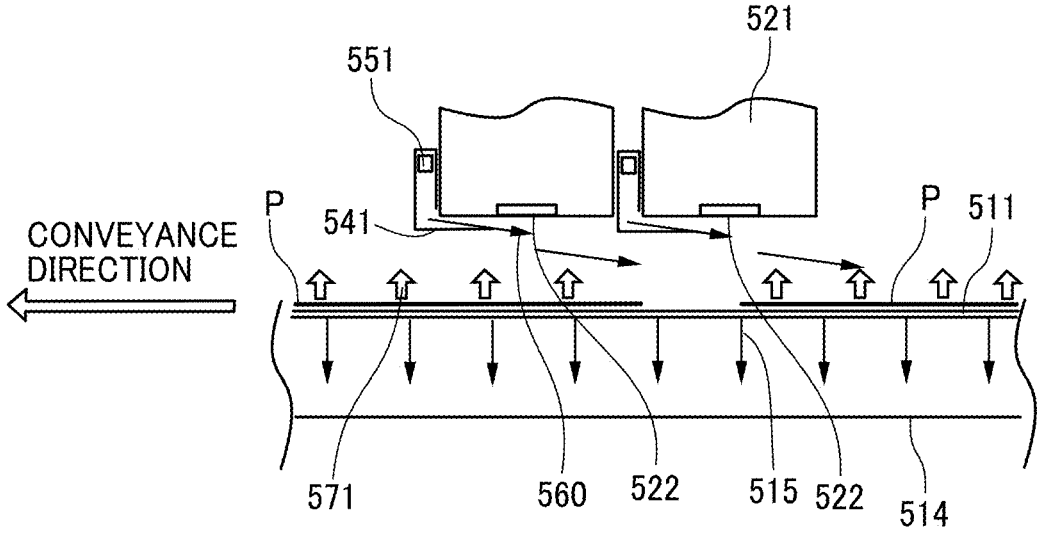
FIG. 16 is a schematic cross-sectional side view of the heating device according to a ninth embodiment of the present disclosure.

FIG. 16 is a schematic cross-sectional side view of the airflow generator 551 of the heating device 500 according to the ninth embodiment in the present disclosure. FIG. 17 is an enlarged cross-sectional side view of the channel plate 541 in the airflow generator 551 in the heating device 500 according to the ninth embodiment in the present disclosure.

In the second to fourth embodiments as described with reference to FIGS. 8 to 10, the heating device 500 includes the airflow generator 551 and the channel plate 541 that generates the airflow 560 passing under the irradiation surface 522 below the ultraviolet irradiator 521 that is disposed one upstream or one downstream of the ultraviolet irradiator 521 in the conveyance direction of the sheet P.

Conversely, the heating device 500 according to the ninth embodiment includes the airflow generator 551 disposed between two ultraviolet irradiators 521 adjacent to each other in the conveyance direction of the sheet P. Further, the heating device 500 includes the channel plate 541 fixed to side plates on both sides of the ultraviolet irradiator 521 in the width direction of the ultraviolet irradiator 521 perpendicular to the conveyance direction of the sheet P. The channel plate 541 is not fixed to the ultraviolet irradiator 521 and may be fixed to the side plates of the housing 503.

For example, at least one of the airflow generator 551 of the plurality of airflow generators 551 is between two ultraviolet irradiators 521 adjacent to each other in the conveyance direction of the plurality of ultraviolet irradiators 521.

The heating device 500 thus facilitates an exchangeability of the ultraviolet irradiator 521.

Figure 17:
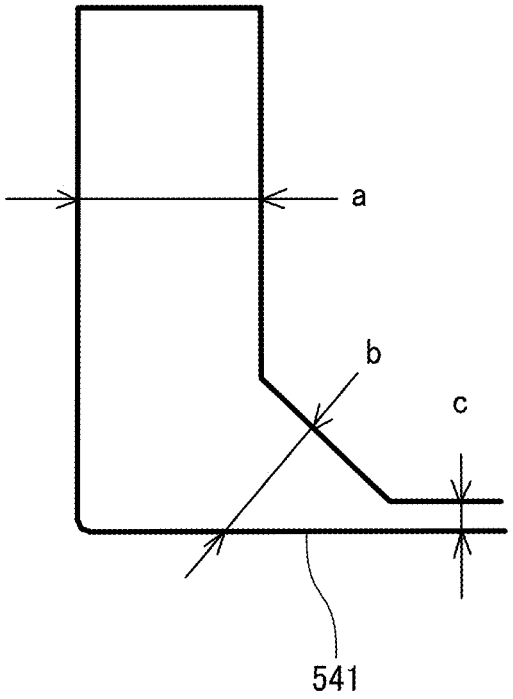
FIG. 17 is a schematic cross-sectional side view of the channel substrate according to a ninth embodiment of the present disclosure.

Further, as shown in FIG. 17, a width of the channel plate 541 is gradually narrowed from an upper portion at which the intake fan 555 is arranged to a lower portion at which a discharge port is arranged (a>b>c). Here, the channel plate 541 includes a space to form a duct through which the airflow 560 flows from the upper portion to the lower portion. The channel plate 541 includes a narrowed discharge port having a width "C" in FIG. 17. The channel plate 541 can generate a substantially uniform airflow 560 in a width direction of the discharge port (direction perpendicular to the conveyance direction of the sheet P).

In each of the above-described embodiments, the first dryer 40 is not limited to the heater 42 such as an IR heater, and can be the same heater such as the ultraviolet irradiator 521 as the second dryer 50. If the first dryer 40 uses the ultraviolet irradiator 521 as same as the second dryer 50, the configuration of the heating device 500 as described above can be applied to the second dryer 50. Further, the first dryer 40 and the second dryer 50 may include the heater such as ultraviolet irradiator 521, and the first dryer 40 and the second dryer 50 heat the sheet P between the transfer cylinder 35 and the first dryer 40 by the heater such as an IR heater.

In the present embodiments, a "liquid" discharged from the head is not particularly limited as long as the liquid has a viscosity and surface tension of degrees dischargeable from the head.

Preferably, the viscosity of the liquid is not greater than 30 mPa·s under ordinary temperature and ordinary pressure or by heating or cooling.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant.

Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source to generate energy to discharge liquid include a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

Examples of the "liquid discharge apparatus" include, not only apparatuses capable of discharging liquid to materials to which liquid can adhere, but also apparatuses to discharge a liquid toward gas or into a liquid.

The "liquid discharge apparatus" may include devices to feed, convey, and eject the material onto which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The "liquid discharge apparatus" is not limited to an apparatus to discharge liquid to visualize meaningful images, such as letters or figures. For example, the liquid discharge apparatus may be an apparatus to form arbitrary images, such as arbitrary patterns, or fabricate three-dimensional images.

The above-described term "material onto which liquid can adhere" represents a material on which liquid is at least temporarily adhered, a material on which liquid is adhered and fixed, or a material into which liquid is adhered to permeate.

Examples of the "material onto which liquid can adhere" include recording media, such as paper sheet, recording paper, recording sheet of paper, film, and cloth, electronic component, such as electronic substrate and piezoelectric element, and media, such as powder layer, organ model, and testing cell.

The "material onto which liquid can adhere" includes any material on which liquid is adhered, unless particularly limited.

Examples of the "material onto which liquid can adhere" include any materials on which liquid can adhere even temporarily, such as paper, thread, fiber, fabric, leather, metal, plastic, glass, wood, and ceramic.

The "liquid discharge apparatus" may be an apparatus to relatively move the head and a material onto which liquid can adhere. However, the liquid discharge apparatus is not limited to such an apparatus. For example, the "liquid discharge apparatus" may be a serial head apparatus that moves the head, a line head apparatus that does not move the head, or the like.

Examples of the "liquid discharge apparatus" further include a treatment liquid coating apparatus to discharge a treatment liquid to a sheet to coat the treatment liquid on a sheet surface to reform the sheet surface, and an injection granulation apparatus in which a composition liquid including raw materials dispersed in a solution is injected through nozzles to granulate fine particles of the raw materials.

The terms "image formation", "recording", "printing", "image printing", and "fabricating" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A heating device comprising:

a conveyor configured to convey a sheet onto which a liquid is applied in a conveyance direction;

an irradiator including a light emitter on an irradiation surface of the irradiator, the light emitter configured to emit light onto the sheet to heat the sheet with the light;

a channel plate between the conveyor and the irradiation surface of the irradiator;

an airflow generator configured to generate an airflow along the irradiation surface between the irradiation surface of the irradiator and the channel plate; and a suction device configured to suck and discharge the airflow in a direction from the irradiation surface of the irradiator toward the conveyor.

2. The heating device according to claim 1, wherein the airflow flows upstream in the conveyance direction of the sheet along the irradiation surface.

3. The heating device according to claim 1, wherein the airflow flows downstream in the conveyance direction of the sheet along the irradiation surface.

4. The heating device according to claim 1, wherein the irradiator includes a plurality of irradiators along the conveyance direction, the airflow generator includes a plurality of airflow generators for the plurality of irradiators, respectively, an airflow generator most upstream in the conveyance direction of the plurality of airflow generators is configured not to generate the airflow, and the plurality of airflow generators other than the airflow generator most upstream in the conveyance direction is configured to generate the airflow along the irradiation surface.

5. The heating device according to claim 1, wherein the irradiator includes a plurality of irradiators along the conveyance direction, the airflow generator includes a plurality of airflow generators for the plurality of irradiators, respectively, and an airflow generator most upstream in the conveyance direction of the plurality of airflow generators is configured to switch operations between a first operation to generate the airflow and a second operation not to generate the airflow.

6. The heating device according to claim 1, wherein the suction device includes suction devices on both ends of the conveyor in a direction perpendicular to the conveyance direction.

7. The heating device according to claim 1, further comprising a guide plate vertically arranged in a direction perpendicular to the conveyance direction, wherein the channel plate is horizontally joined to the guide plate, the airflow generator includes intake fans at both ends of the irradiator in a direction perpendicular to the conveyance direction, and the intake fans generate the airflow in a horizontal direction along the guide plate.

8. The heating device according to claim 1, further comprising a guide plate vertically arranged in a direction perpendicular to the conveyance direction, wherein the channel plate is horizontally joined to the guide plate, the airflow generator includes a plurality of intake fans in a direction perpendicular to the conveyance direction, and the plurality of intake fans generates the airflow in a vertical direction from the irradiation surface toward the conveyor.

9. The heating device according to claim 1, wherein the irradiator includes a plurality of irradiators along the conveyance direction, the airflow generator includes a plurality of airflow generators for the plurality of irradiators, respectively, an airflow generator most upstream in the conveyance direction of the plurality of airflow generators is configured to generate the airflow that flows downstream in the conveyance direction of the sheet along the irradiation surface, and the plurality of airflow generators other than the airflow generator most upstream in the conveyance direction is configured to generate the airflow that flows upstream in the conveyance direction of the sheet along the irradiation surface.

10. The heating device according to claim 1, wherein the light is infrared light.

11. The heating device according to claim 1, wherein the light is ultraviolet light.

12. The heating device according to claim 1, further comprising a guide plate vertically arranged in a direction perpendicular to the conveyance direction, wherein the channel plate is horizontally joined to the guide plate, the airflow generator includes an intake fan at one end of the irradiator in a direction perpendicular to the conveyance direction, and the intake fan generates the airflow in a horizontal direction along the guide plate.

13. The heating device according to claim 1, wherein the irradiator includes a plurality of irradiators along the conveyance direction, the airflow generator includes a plurality of airflow generators for the plurality of irradiators, respectively, wherein at least one of the plurality of airflow generators is between two irradiators adjacent to each other in the conveyance direction of the plurality of irradiators.

14. The heating device according to claim 1, wherein the airflow generator includes:

an intake fan at an upper portion of the channel plate; and a discharge port at a lower portion of the channel plate, and a width of the channel plate is gradually narrowed from the upper portion to the lower portion.

15. A liquid discharge apparatus comprising:

a liquid application unit configured to apply a liquid onto a sheet; and the heating device according to claim 1, the heating device configured to heat the sheet onto which the liquid is applied.

16. A printer comprising:

a liquid application unit configured to apply a liquid onto a sheet; and the heating device according to claim 1, the heating device configured to heat the sheet onto which the liquid is applied.

* * * * *